United States Patent [19]

Curry et al.

[11] Patent Number: 4,720,918

[45] Date of Patent: Jan. 26, 1988

[54] RAZOR BLADES

[76] Inventors: Francis R. Curry, 3 Carlisle Gardens, Twyford, Berkshire; Joan Pumfrey, Herns House, Gallowstree Common, Reading, Berkshire; Edwin L. Glasson, 35 Emmetts Park, Binfield, Bracknell, Berkshire; Romuald Kozlowski, deceased, late of Hanwell; by Jadwiga Kozlowska, legal representative, 54 Greenford Avenue, Hanwell, London, all of England, by said Edwin L. Glasson, legal representative

[21] Appl. No.: 870,622

[22] Filed: Jun. 4, 1986

Related U.S. Application Data

[63] Continuation of Ser. No. 634,110, Jul. 18, 1984, abandoned.

[30] Foreign Application Priority Data

Nov. 19, 1982 [GB] United Kingdom ..... 8233014
Nov. 14, 1983 [WO] PCT Int'l Appl.... PCT/GB83/00288

[51] Int. Cl.[4] ..... B26B 21/54
[52] U.S. Cl. ..... 30/346.55; 30/346.5
[58] Field of Search ..... 30/346.53, 346.54, 346.58, 30/346.5, 346.55; 76/101 R

[56] References Cited

U.S. PATENT DOCUMENTS 3,835,537 9/1974 Sastri ..... 30/346.53

*Primary Examiner*—Douglas D. Watts

[57] ABSTRACT

A razor blade edge tip has a cross-sectional shape defined, over up to 40 μm from the extreme edge by the equation $w=ad^n$, in which w is the tip chord thickness in μm at a distance d from the extreme edge; a is factor of proportionality not greater than 0.8, and n is an exponent having a value in the range 0.65 to 0.75.

This results in a tip shape which is relatively thick very close to the edge but whose overall cross-section is narrow, compared with known tip shapes.

6 Claims, 12 Drawing Figures

RAZOR BLADES

This is a continuation of application Ser. No. 634,110, filed July 18, 1984, abandoned.

This invention relates to razor blades and is particularly concerned with the shaping of the cutting edge.

The invention resides broadly in a razor blade having a cutting edge the cross-sectional shape of which within the first 40 μm measured back from the extreme edge is defined by the formula $w=ad^n$ wherein d is the distance from the tip in μm; w=the tip width (or thickness) in μm at a given distance d; a is a factor of proportionality of about 0.8 and n is an exponent having a value less than 0.75, and wherein the included angle between the tip facets in the region from 40 μm to 100 μm from the extreme edge is within the range 7°–14° and preferably 9° to 11½°.

In the case of a stainless steel blade n is in the range 0.65 to 0.75 and a is in the range 0.71–0.92.

It has been found that blades having these tip characteristics provide improved shaving on comparative shave testing, but are sufficiently strong to give a reasonable useful life.

In order to convey a proper understanding of the nature of the present invention, it is convenient to describe and illustrate the background prior art in some detail. In the accompanying drawings.

Figure 1:
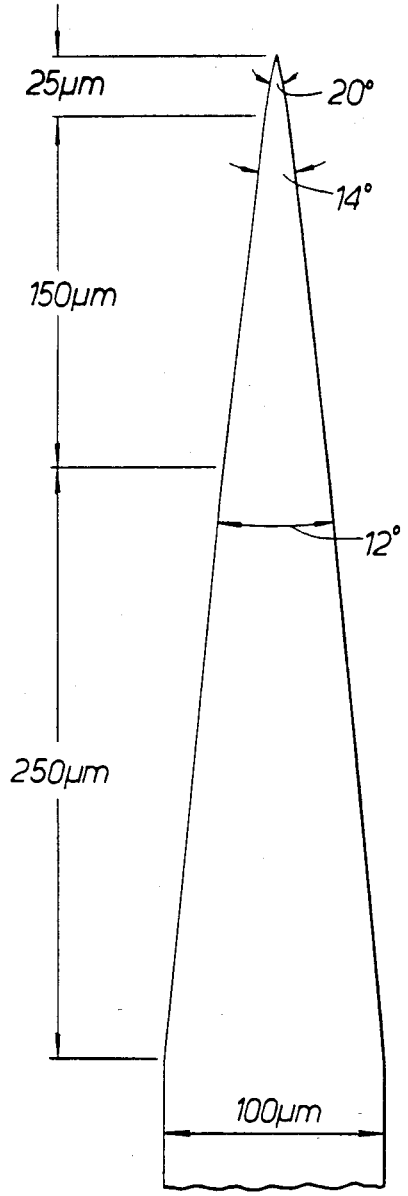
FIG. 1 is a greatly magnified view of a blade tip of typical, or average shape.
Figure 2:
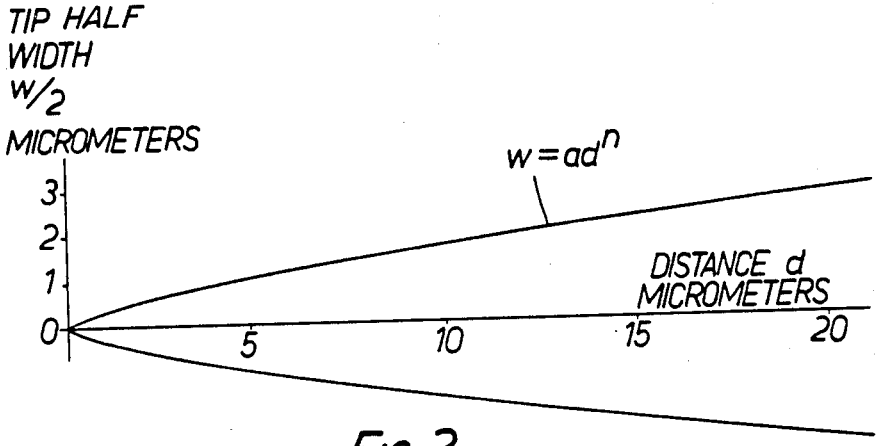
FIG. 2 is a tip shape diagram illustrating the principle of "tip-width" measurement.

Cutting edges on razor blades are sharpened by grinding a succession of pairs of facets (usually three) of different included angles onto a strip of steel by means of suitably arranged abrasive wheels. The cross-section through such an edge is illustrated in FIG. 1 with typical values for dimensions and angles shown, and is customarily described as a "3-facet edge". While the final pair of facets is being ground, (this stage is usually called "honing"), strip deflection in the sharpening machine together with the mechanical interaction between the steel and the abrasive particles of the wheel, produces final facets which are usually not planar but slightly convex. The curvature is a function of the type of steel and abrasive wheel used, as well as the sharpening machine setting parameters. Because of this convexity of the final facets, the blade tip cross section in this region is customarily referred to as "Gothic arched". The curvature prohibits precise geometrical definition of this part of the blade tip by means of a single parameter so that it is usual to characterise the shape by defining tip thicknesses widths at various distances back from the edge. An alternative method is to ascribe a mathematical equation to fit the form of each half of the facet cross-section. These methods are illustrated in FIG. 2.

Figure 3:
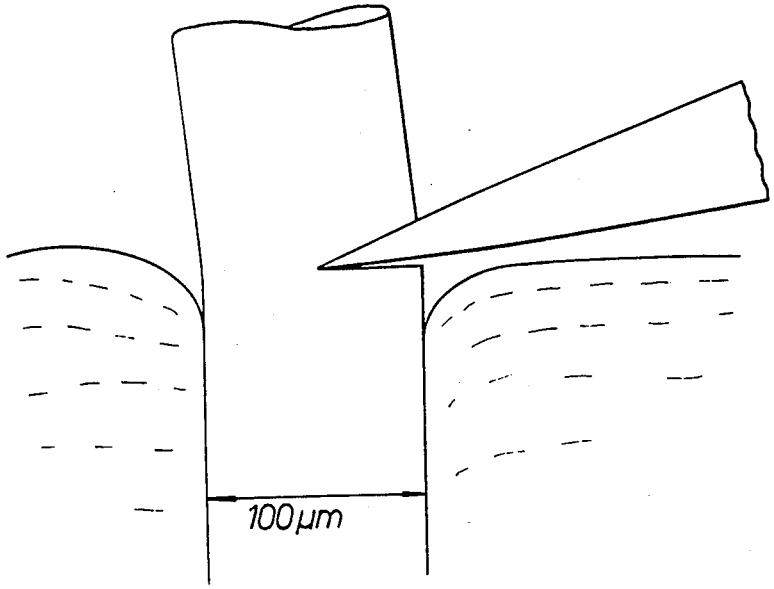
FIG. 3 is a highly diagrammatic representation of the cutting of a facial hair.
Figure 4:
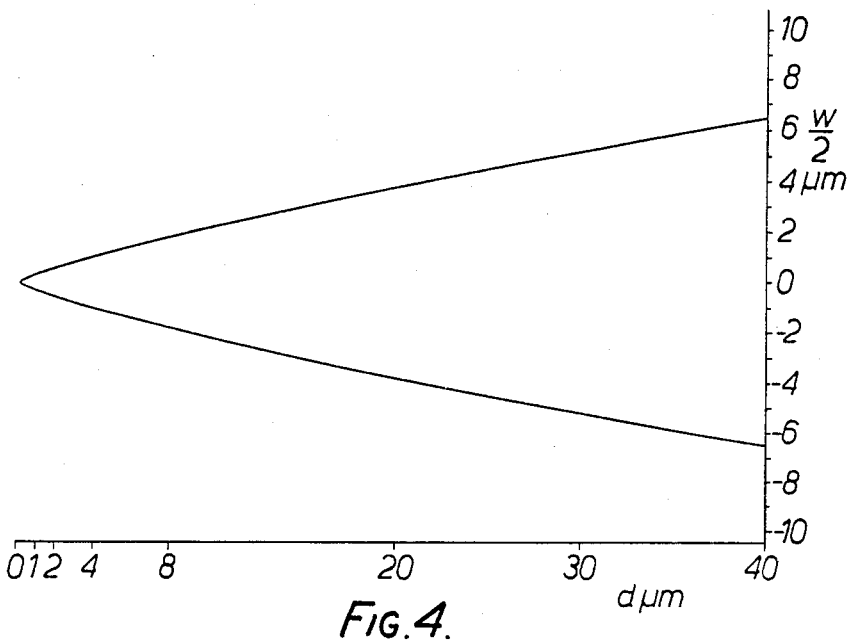
FIGS. 4 to 7 are cross-sections of various respective blades currently marketed by a variety of manufacturers.
Figure 5:
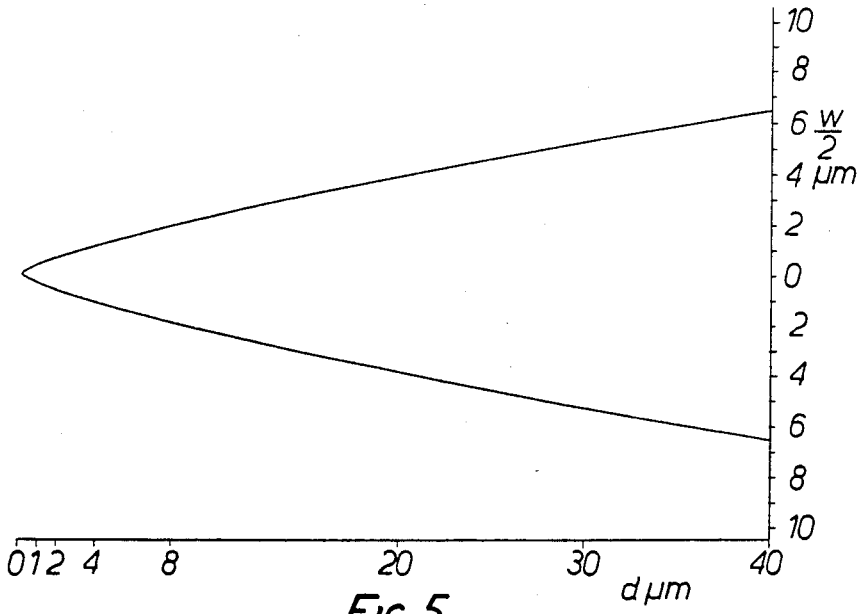
Figure 6:
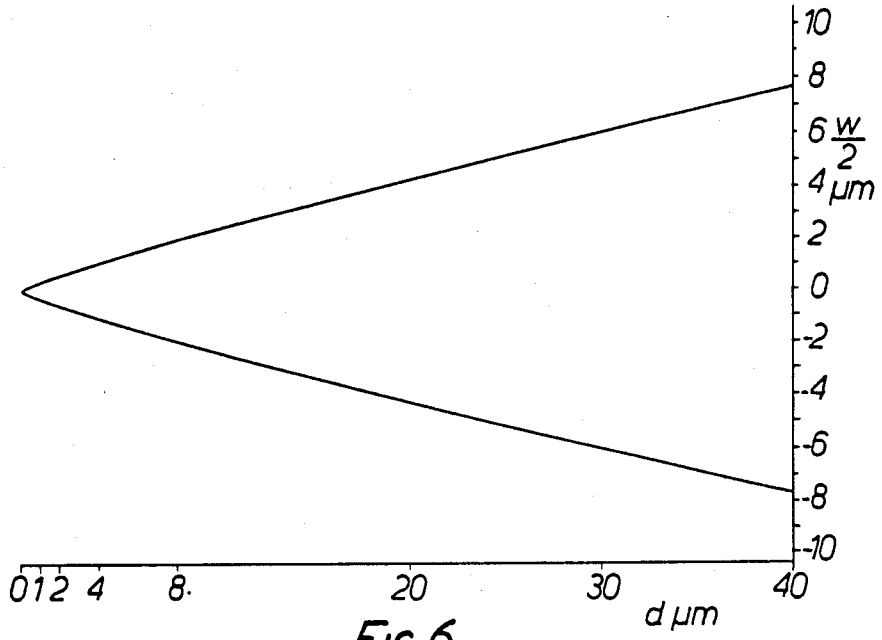
Figure 7:
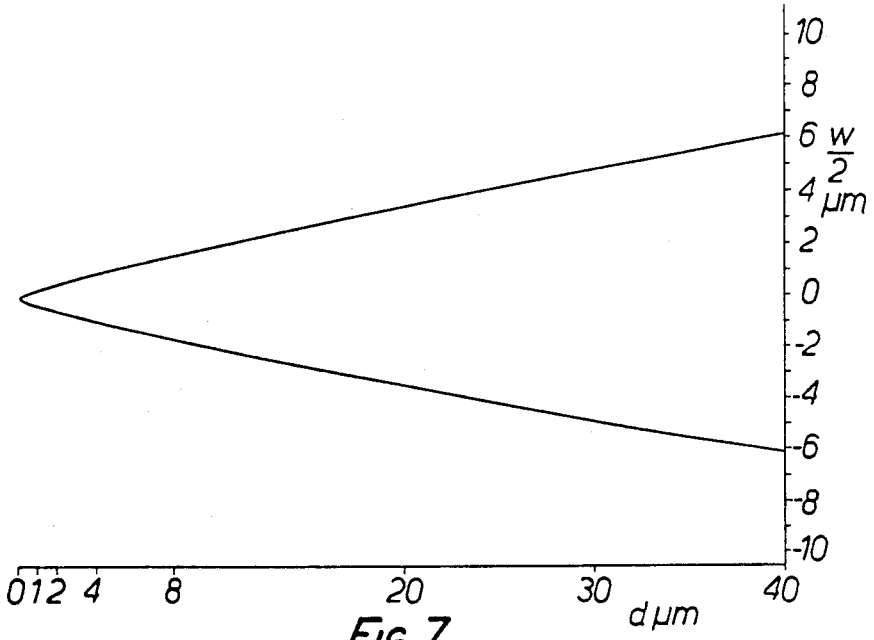
Figure 8:
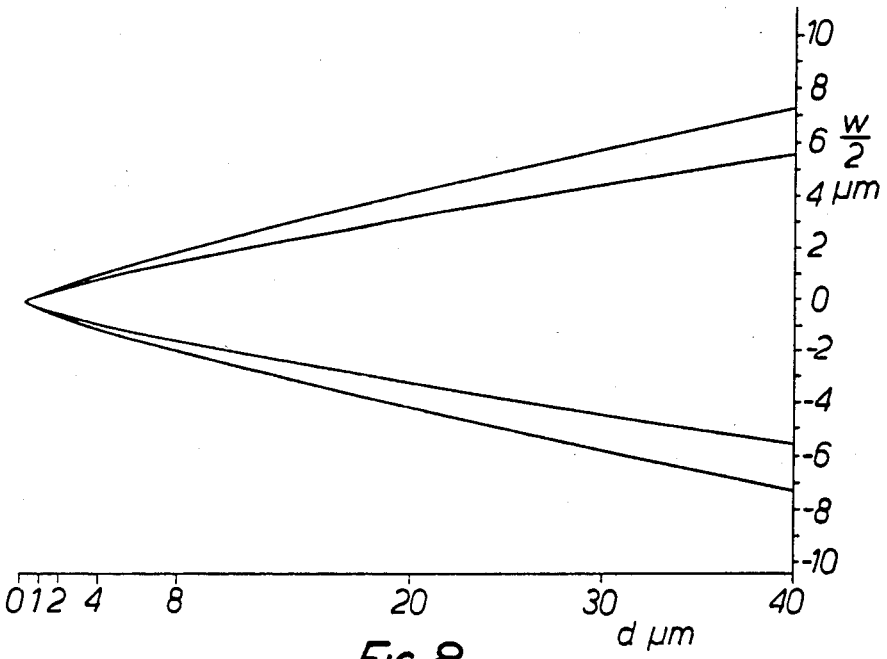
FIG. 8 is a view, like FIGS. 4 to 7, of the tip shapes described in British Patent Specification No. 1465697.

During use, a razor blade is held in the razor at an angle of approximately 25°, and with the edge in contact with the skin, it is moved over the face so that when the edge encounters a beard hair, it enters and severs it by progressive penetration, aided by a wedging action. It is believed that the cut portion of the hair (which is on average about 100 μm diameter) remains pressed in contact with the blade facets remote from the facial skin surface for a penetration up to only about half the hair diameter. Beyond this, the hair can bend and contract away from the blade to relieve the wedging forces. The resistance to penetration through reaction between hair and blade facets therefore occurs only over about the first 50 μm of the blade tip back from the edge and the geometry of the blade tip in this region is regarded as being the most important from the cutting point of view. This is illustrated in FIG. 3.

It is clear that a reduction in the included angle of the facets would correspondingly reduce the resistance to continued penetration of the blade tip into the hair. However, if the included angle were reduced too much, the strength of the blade tip would be inadequate to withstand the resultant bending forces on the edge during the cutting process and the tip would deform plastically (or fracture in a brittle fashion, depending on the mechanical properties of the material from which it is made) and so sustain permanent damage, which would impair its subsequent cutting performance, i.e. the edge would become 'blunt' or 'dull'.

In order to design a suitable shape for the blade tip which is just strong enough to prevent such bending induced damage, an estimation has been made of the magnitude of the bending stresses imposed during the severing of a hair. From these values and a knowledge of the yield strength of the steel from which the blade is made, minimum dimensions can be calculated for the tip section. The stresses imposed during cutting were assumed to arise from the visco-elastic flow of saturated hair material past the blade tip.

Blades currently produced have tip geometries with some dimensions which are below these minimum values and are known to become dulled by edge bending during the normal shaving life (which is on average, approximately 10 days for a blade made from conventional razor blade stainless steel).

We have now found that by careful control of the tip geometry in specific regions 0–40 μm from the edge, the overall cross-section can be reduced so that cutting performance and shaving satisfaction are improved, while retaining adequate strength to resist edge bending damage and so maintain acceptable durability.

The tip shapes of various manufacturers blades currently on the market are shown in FIGS. 4 to 7, and FIG. 8 illustrates blade tip forms as described in British Pat. No. 1465967.

Figure 10:
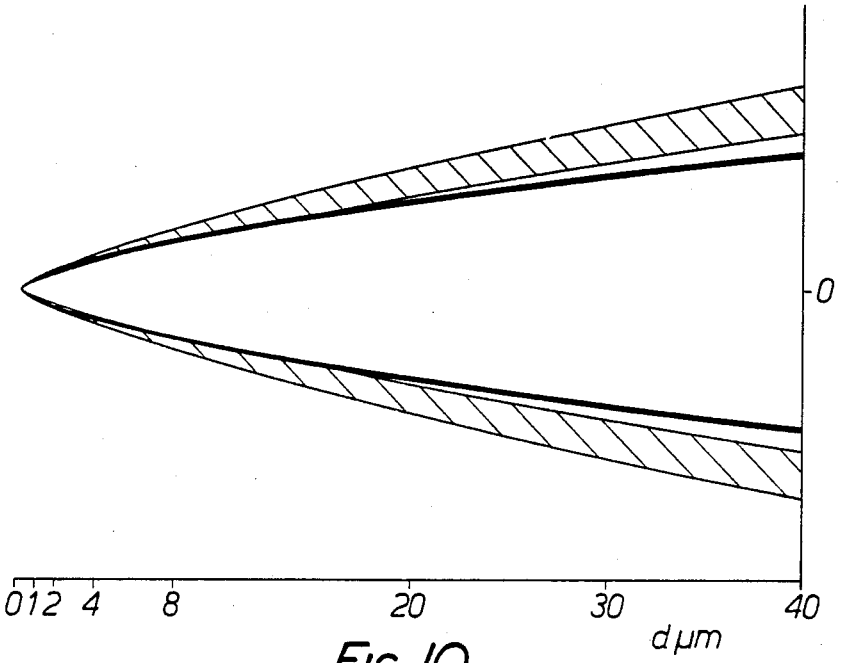
FIGS. 10 and 10A are representations of blade tip forms.
Figure 10A:
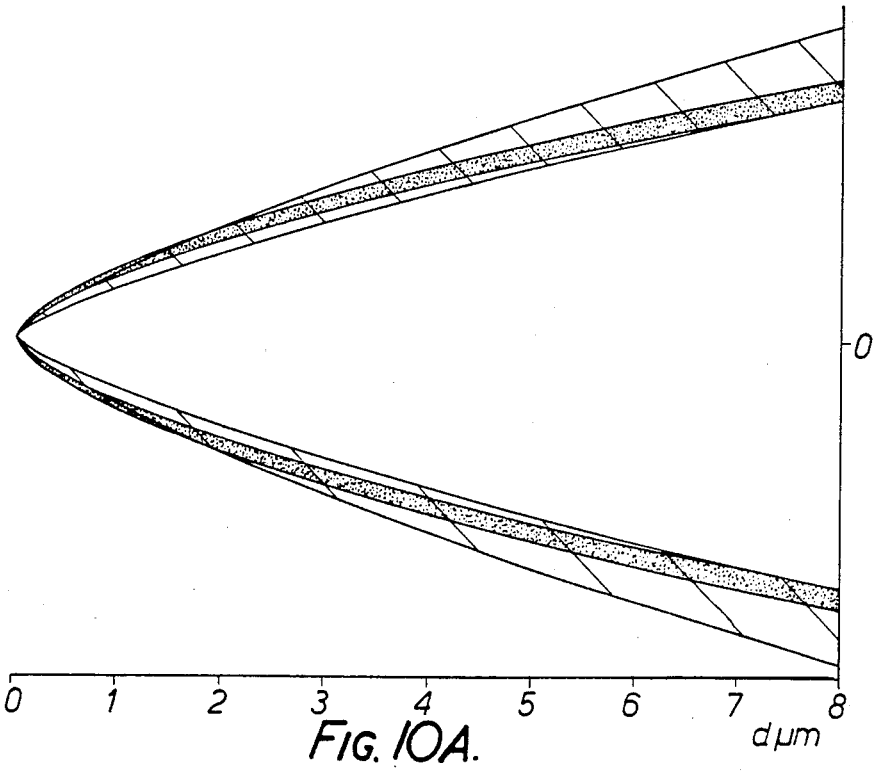

These known blade tip shapes are compared with the preferred blade tip shape of the present invention in FIGS. 10 and 10A.

In one form of the present invention, the blade tip cross-section is first narrowed by grinding the three facets to smaller included angles than those typified in FIG. 1. This produces a blade tip whose cross-section is generally narrower throughout and, importantly, in the 0–40 μm distance back from the edge, which is of particular interest during hair cutting. Such an edge is too weak to withstand stresses during shaving and must be further modified. This is achieved by adding what amounts to a fourth sharpening stage. It is carried out using rotating interlocking discs or spirals of leather or synthetic leather, (usually called "strops") with abrasive material added to their peripheries. The sharpened blades pass between the strops, which polish the facets, removing a small amount of steel from their surfaces, and so changing the "Gothic arch" dimensions. This stage is called "abrasive stropping". Because of the flexibility of the strop leather, allowing it to conform somewhat to the sharpened blade tip, abrasive stropping increases the curvature of the final facet, close to the edge, while having less effect on the facet shape further back.

It has been found that when blades are sharpened with suitably reduced facet included angles, followed by an appropriate abrasive stropping treatment, the tip shape is changed so that the tip widths close to the edge become larger than those on conventionally sharpened edges, while the tip widths further away from the edge remain smaller than those on conventionally sharpened edges. This results in the blade tip close to the edge being stronger than normal, so that it can better resist the bending stresses imposed on it during hair cutting, while the reduced section further back from the edge, presents less resistance to penetration during hair cutting, so facilitating the cutting process.

The ultimate tip radius of the edge should be conventional, with an average value of less than 1000° A and preferably less than 500° A as stated, for example, in Patent Specification No. 1,378,550 (U.S. Pat. No. 3,761,374), that is, within the normal range for conventionally sharpened edges.

Blades in accordance with the invention have been found to have superior shaving performance when compared with conventional blades on a standard shaving test.

Figure 9:
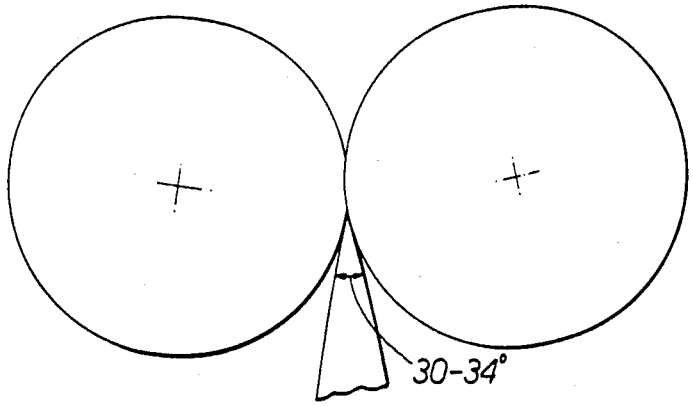
FIG. 9 is a diagrammatic illustration of a blade tip stropping operation.

One form of blade in accordance with the invention and the manner in which it is formed are described in detail below, by way of example, with reference to FIGS. 9, 10 and 11, in which:

FIG. 9 is a diagrammatic illustration of a blade tip stropping operation;

FIGS. 10 and 10A are representations of blade tip forms in accordance with the invention, compared with the known blade tip forms seen in FIGS. 4 to 8. FIG. 10A is a detail from FIG. 10 on a larger scale; and FIG. 11 is a graph of tip widths 'w' at different distances 'd' plotted on logarithmic scales.

Stainless steel razor blade strip, of nominal composition 13% Cr, 0.6% C, was hardened and tempered in accordance with conventional practice, and sharpened by grinding and honing to produce edges of three facet configuration, as illustrated in FIG. 1, but with included angles smaller than those conventionally manufactured. The blades were passed between rotating strops of artificial leather, whose surfaces contained fine alumina abrasive, in the manner of conventional abrasive stropping, where the angle set on the strops (which is the included angle between the tangents to the strops at their point of intersection, as shown in FIG. 9) was in the range 30°–34°. The facets were provided with a metallic coating of an alloy of chromium and platinum (applied in accordance with U.S. Pat. No. 3,829,969) with a superimposed coating of fluorocarbon material, (such as described in British Pat. No. 906,005).

The processes of grinding, honing and stropping are well known in the art, but it will be understood that less conventional methods could be employed for sharpening the tip, e.g. deforming the strip between appropriately shaped dies or rollers, or by electrolytic or chemical dissolution shaping or by ion bombardment shaping.

The blade tip cross-sections were measured using optical interferometry. A blade is placed under the objective lens of a metallurgical microscope fitted with a Michelson type interferometer and viewed at a magnification of about 1000×. The interferometer is adjusted to produce fringes which are oriented at right angles to the edge of the blade. The blade is tilted at an appropriate angle so that the fringes are displaced to reveal the topography of the blade facets. The fringe spacing is adjusted so that fringe displacements can be readily measured at various distances back from the edge. Knowing the angle of tilt, the tip shape is calculated from the sum of these fringe displacements, measured at corresponding positions on each side of the blade.

The results of these measurements are shown in FIG. 10, in which the spread of profiles of the preferred blade tips over the first 40 μm are shown by solid shaded bands, and the spread of profiles of known blades is indicated by the cross-hatched bands.

In this specific example, the tip widths w at distances d from the extreme edge were as set out below:

| d (μm) | w (μm) |
|---|---|
| 0.25 | .20–.30 |
| 0.5 | .34–.50 |
| 0.75 | .53–.72 |
| 1.0 | .71–.92 |
| 2.0 | 1.17–1.37 |
| 4.0 | 1.86–2.16 |
| 8.0 | 3.05–3.52 |
| 20.0 | 6.12–6.85 |
| 30.0 | 8.43–9.52 |
| 40.0 | 10.73–12.11 |

Figure 11:
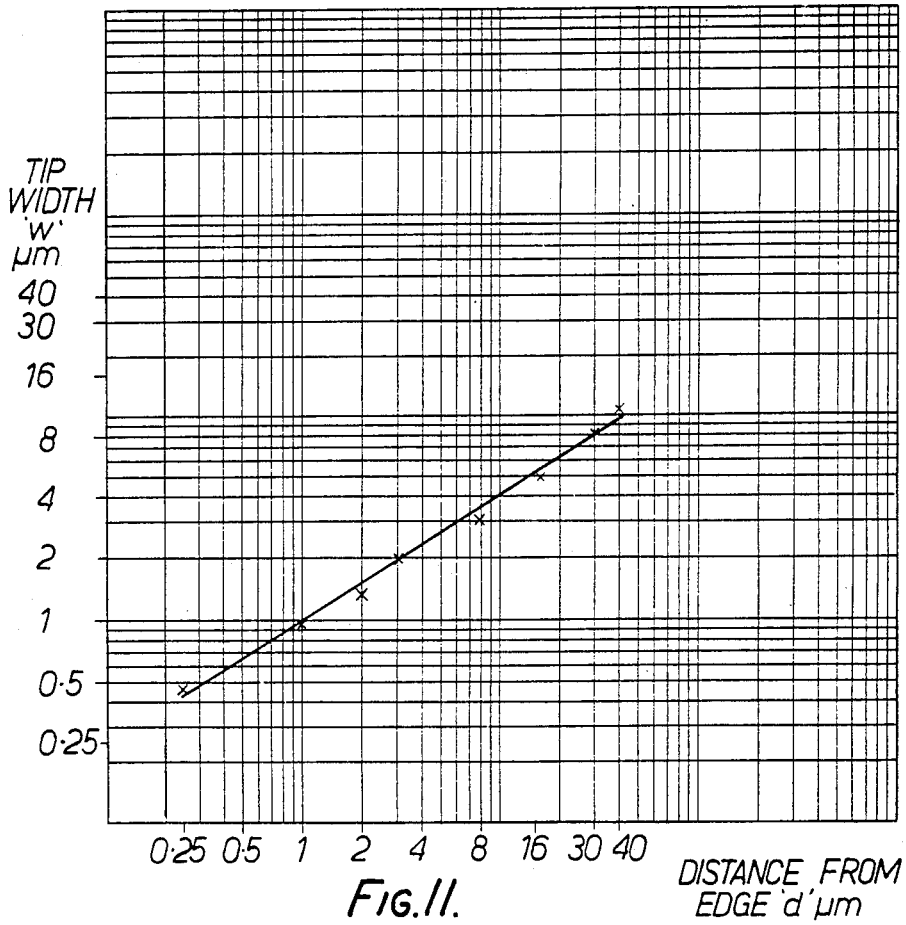
FIG. 11 is a graph of tip widths versus distance.

The geometry of this profile was re-plotted on a graph using logarithmic scales for tip thickness as a function of distance from the edge and the resultant plot is shown in FIG. 11, from which it is seen that a straight line can be fitted to the plotted points.

From the slope and intercept of the straight line, the tip shape can be defined by the equation $w=ad^n$ in which a is a factor of proportionality of about 0.8 and n an exponent having a value of not more than 0.75, and more specifically within the range 0.65–0.75.

The known blades measured were found to have best fit straight lines with exponents (or gradients) within the range 0.76–1.0.

The smaller gradient is a primary characteristic of the present invention and results in the fact that the blade tip of the present invention, compared with those of the prior art, is relatively thick and strongly arched close to the extreme edge, but relatively thin over the remainder of the tip.

The included facet angles in the region 40–100 μm from the tip are in the range 9° to 11½° but making due allowance for manufacturing tolerance could be in the range 7° to 12° or even 7° to 14°.

It must be appreciated that the tip shapes described above are for stainless steel blades and could be made substantially thinner for harder blade materials such as sapphire, titanium carbide or diamond.

To produce an equivalent tip shape from a material harder than stainless steel, we reduce the corresponding tip widths in inverse proportion to the square root of the yield strength of the harder material in comparison with stainless steel. In the case of diamond, for example, the tip widths would be approximately 40% of those calculated for stainless steel.

Furthermore, the tip region of a stainless steel blade may be coated with a material harder than stainless steel and having a higher yield strength. In such a case the chord widths given by the basic equation are reduced by adopting the modified formula:

$$w \geqq \frac{1}{\sqrt{m}} a.d.^n$$

in which m is the ratio of the yield strength of the coating material to that of stainless steel.

Furthermore, in order to ensure the integrity of the steel substrate, the value for w must also satisfy the equation $w^3 \geqq (w-2h)a^2d^{2n}$, where h is the thickness of the coating.

It will be understood by those skilled in the art that the blade tips may, in each case, be coated with materials such as p.t.f.e, which further enhance the cutting action. The thicknesses of such coatings are, of course ignored for the purposes of calculating the tip chord widths.

We claim:

1. A razor blade having a cutting edge tip of a material which has a higher yield strength than stainless steel, the cross-sectional shape of which up to a distance of forty micrometers from the extreme edge is defined by the equation:

$$w=ad^n$$

in which w is the thickness in micrometers of the tip at a distance d in micrometers from the extreme edge of the blade; a is a factor of proportionality not greater than 0.8; n is an exponent having a value in the range 0.65 to 0.75; and the width w obtained from the said equation is reduced in inverse proportion to the square root of the ratio of the yield strength of said tip material to that of stainless steel.

2. A razor blade having a cutting edge tip of stainless steel, said cutting edge tip being coated with a material having a greater yield strength than stainless steel, the cross-sectional shape of said tip up to a distance of forty micrometers from the extreme edge being defined by the equation:

$$w=ad^n, \quad (1)$$

in which w is the thickness in micrometers of the tip at a distance d in micrometers from the extreme edge of the blade; a is a factor of proportionality not greater than 0.8; and n is an exponent having a value in the range 0.65 to 0.75; and by the equation;

$$w \geqq \frac{1}{\sqrt{m}} ad^n \quad (2)$$

in which m is the ratio of the yield strength of the coating material to that of stainless steel; and by the equation:

$$w^3 \geqq (w-2h)a^2d^{2n}, \quad (3)$$

in which h is the thickness in micrometers of the coating.

3. A razor blade having a cutting edge tip of stainless steel, the cross-sectional shape of which up to a distance of forty micrometers from the extreme edge is defined by the equation:

$$w=ad^n$$

in which w is the thickness of micrometers of the tip at a distance d in micrometers from the extreme edge of the blade; a is a factor of proportionality not greater than 0.8 and n is an exponent having a value in the range 0.65 to 0.75; and wherein the blade tip is formed with facets at a distance between forty and one hundred micrometers from the extreme edge, which facets converge toward the edge at an included angle in the range 9° to 11½°.

4. A razor blade having a cutting edge tip of gothic arch configuration, at least the tip of said blade including a material which have a higher yield strength than stainless steel, the cross-sectional shape of said blade up to a distance of forty micrometers from the extreme edge being defined by the equation:

$$w=ad^n,$$

in which w is the thickness in micrometers of the tip at a distance d in micrometers from the extreme edge of the blade; a is a factor of proportionality not greater than 0.8; n is an exponent having a value in the range of 0.65–0.75; and the blade tip is formed with facets at a distance between forty and one hundred micrometers from the extreme edge, which facets converge toward the edge at an included angle in the range 9° to 11½°.

5. A razor blade having a cutting edge, the cross-sectional shape of said cutting edge being such that the tip thicknesses w at distances d from the tip of said cutting edge lie within the following ranges:

| d (micrometers) | w (micrometers) |
|---|---|
| 0.25 | .20–.30 |
| 0.5 | .34–.50 |
| 0.75 | .53–.72 |
| 1.0 | .71–.92 |
| 2.0 | 1.17–1.37 |
| 4.0 | 1.86–2.16 |
| 8.0 | 3.05–3.52 |
| 20.0 | 6.12–6.85 |
| 30.0 | 8.43–9.52 |
| 40.0 | 10.73–12.11 |

said cutting edge tip being of gothic arch configuration, the cross-sectional shape of said blade up to a distance of forty micrometers from the extreme edge being defined by the equation:

$$w=ad^n,$$

in which w is the thickness in micrometers of the tip at a distance d in micrometers from the extreme edge of the blade, a is a factor of proportionality having a value in the range of 0.71–0.92, and n is an exponent having a value in the range of 0.65–0.75.

6. A razor blade according to claim 2 wherein the gothic arch configuration has been changed by removing a small amount of steel from the tip surfaces by abrasive stropping after the final facets of the blade have been formed by honing.

* * * * *

UNITED STATES PATENT AND TRADEMARK OFFICE

CERTIFICATE OF CORRECTION

PATENT NO. : 4,720,918

DATED : January 26, 1988

INVENTOR(S) : Francis R. Curry, et al.

It is certified that error appears in the above-identified patent and that said Letters Patent are hereby corrected as shown below:

Col. 6, claim 3, line 8, "of" should be --in--.

Col. 6, claim 6, line 63, "2" should be --5--.

The following references were omitted from the patent:

| Patent No. | Date | Name | Class |
|---|---|---|---|
| 3,461,616 | 8/19/69 | Nissen | 51/87 |
| 3,811,189 | 5/21/74 | Sastri | 30/346.53 |
| 4,265,055 | 5/5/81 | Cartwright | 51/80 |

| Patent No. | Date | Country |
|---|---|---|
| 2,234,100 | 01/17/75 | France |
| 1,198,506 | 10/13/67 | Great Britain |
| 1,258,348 | 12/30/71 | Great Britain |
| 1,350,594 | 05/04/71 | Great Britain |
| 1,465,697 | 05/24/74 | Great Britain |

Signed and Sealed this

Twentieth Day of December, 1988

*Attest:*

*Attesting Officer*

DONALD J. QUIGG

*Commissioner of Patents and Trademarks*